US010699683B2

(12) United States Patent
Snyder

(10) Patent No.: US 10,699,683 B2
(45) Date of Patent: Jun. 30, 2020

(54) RHYTHM SHAKER

(71) Applicant: Alan T. Snyder, Eastern Passage (CA)

(72) Inventor: Alan T. Snyder, Eastern Passage (CA)

( * ) Notice: Subject to any disclaimer, the term of this patent is extended or adjusted under 35 U.S.C. 154(b) by 0 days.

(21) Appl. No.: 16/438,294

(22) Filed: Jun. 11, 2019

(65) Prior Publication Data

US 2019/0392793 A1 Dec. 26, 2019

(51) Int. Cl.
*G10D 13/06* (2020.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS 6,555,736 B1 * 4/2003 Delosreyes ..... G10D 13/06 84/402

* cited by examiner

*Primary Examiner* — Kimberly R Lockett
(74) *Attorney, Agent, or Firm* — Douglas Denninger

(57) ABSTRACT

There is provided a rhythm shaker for producing percussive sound. The shaker has a shell that envelops a hollow interior that contains a number of percussive particles. The rhythm shaker's shell has an internal surface on which the enclosed sound producing material can strike the shell and make a sound where the sidewalls of the shell have at least two different thicknesses which, when struck by the enclosed sound producing material, produces a different sound depending on the thickness of the shell where struck.

22 Claims, 6 Drawing Sheets

RHYTHM SHAKER

TECHNICAL FIELD

The present disclosure relates to musical instruments. In particular, the present invention relates to a percussion instrument known as a shaker, a musical shaker, or rhythm shaker.

DESCRIPTION OF THE RELATED ART

Rhythm shakers in various forms are often used in the rhythm sections of orchestras and other musical groups to establish rhythm or to provide musical texture in musical performances. Rhythm shakers are used into virtually every form of music.

A typical rhythm shaker is a hollow container or shell, having a number of relatively small percussive media, such as metal shot, plastic beads, seeds or small stones, contained therein. The percussive media occupies a relatively small proportion of the internal volume of the rhythm shaker. A rhythm shaker is operated by shaking it back and forth or around. As such, when the rhythm shaker is operated in this manner, the percussive media through inertia, hits the inside surface of the container or shell which produces a percussive sound. When this action is repeated, the sound produced establishes rhythm in musical performances and can add dimension to music.

Rhythm shakers known in the prior art are typically constructed of various materials including plastic, wood, metal, ceramics with a consistent shell thickness such that a consistent sound is produced when the percussive media strikes the shell, regardless of the position of where the percussive media strikes the shell, regardless of the orientation of the rhythm shaker, and regardless of the direction of the shaking of the rhythm shaker.

Thus, a disadvantage present with the rhythm shakers known in the art is that only a single tone or timbre or type of sound may be produced by a single rhythm shaker. Consequently, there exists a need for a rhythm shaker instrument where the percussive media strikes portion of the outer shell to make a particular sound when the shaker is moved in one direction as and where the percussive media strikes a different portion of the outer shell to make a different particular sound when the shaker is moved in another direction. This would allow the musician to play differing sounds or tones or timbres with one rhythm shaker.

BRIEF SUMMARY

A rhythm shaker is disclosed having a shell having a plurality of sidewalls of a plurality of thicknesses, percussive media and at least one end cap, the plurality of sidewalls and the at least one end cap defining a closed interior cavity, the percussive media contained within the closed interior cavity. In another embodiment, a rhythm shaker is disclosed having a shell having a plurality of sidewalls of a plurality of thicknesses, two end caps, and percussive media, the plurality of sidewalls and the two end caps defining a closed interior cavity, the percussive media contained within the closed interior cavity. In another embodiment, a rhythm shaker is disclosed having a shell having an enclosing sidewall of varying thickness, and percussive media, the sidewalls defining and interior with the percussive media contained within the interior. In another embodiment, a rhythm shaker is disclosed having a sidewall of varying thickness varies at a constant rate across the sidewall. In another embodiment, a rhythm shaker is disclosed having a sidewall of varying thickness does not vary at a constant rate across the sidewall. In another embodiment, a rhythm shaker is disclosed having a sidewall of varying thickness constitutes an indentation in the sidewall. In another embodiment, a rhythm shaker is disclosed wherein the percussive media is selected from the group consisting of ball bearings, metal shot, buckshot, plastic bead, glass bead, pellet, seed, rice, stone, and any combinations thereof. In another embodiment, a rhythm shaker is disclosed wherein the ball bearings are steel. In another embodiment, a rhythm shaker is disclosed wherein the ball bearings are stainless steel. In another embodiment, a rhythm shaker is disclosed wherein the ball bearings are stainless steel of a plurality of diameters. In another embodiment, a rhythm shaker is disclosed wherein at least one of the plurality of sidewalls is made from a material selected from the group consisting of plastic, metal, wood, bamboo, carbon fibre, and any combinations thereof. In another embodiment, a rhythm shaker is disclosed wherein the shell has a hexagonal cross-section. In another embodiment, a rhythm shaker is disclosed wherein the shell has a square cross-section. In another embodiment, a rhythm shaker is disclosed wherein the shell has a rectangular cross-section. In another embodiment, a rhythm shaker is disclosed wherein the shell has four sidewalls and wherein two sidewalls are of a thinner thickness than the other two sidewalls. In another embodiment, a rhythm shaker is disclosed wherein the two sidewalls of a thinner thickness are adjacent. In another embodiment, a rhythm shaker is disclosed wherein the two sidewalls of a thinner thickness are not adjacent. In another embodiment, a rhythm shaker is disclosed wherein the shell has a triangular cross-section. In another embodiment, a rhythm shaker is disclosed wherein the shell has a tubular cross-section. In another embodiment, a rhythm shaker is disclosed wherein the shell has an irregular cross-section. In another embodiment, a rhythm shaker is disclosed wherein the shell has a circular cross-section. In another embodiment, a rhythm shaker is disclosed wherein the shell has an oval cross-section. In another embodiment, a rhythm shaker is disclosed wherein the shell is rigid. In another embodiment, a rhythm shaker is disclosed wherein the percussive media is loosely disposed within the closed interior cavity for striking a portion of the closed interior cavity when the rhythm shaker is moved.

BRIEF DESCRIPTION OF DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DESCRIPTION OF SPECIFIC EMBODIMENTS

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known materials, structures and methods associated with vehicles have not been shown or described in detail, to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a", "an", and "the" include plural referents unless the content clearly dictates otherwise. It should also be noted that the term "or" is generally employed in its sense including "and/or" unless the content clearly dictates otherwise.

The headings and Abstract provided herein are for convenience only and do not interpret the scope or meaning of the embodiments.

Figure 1:
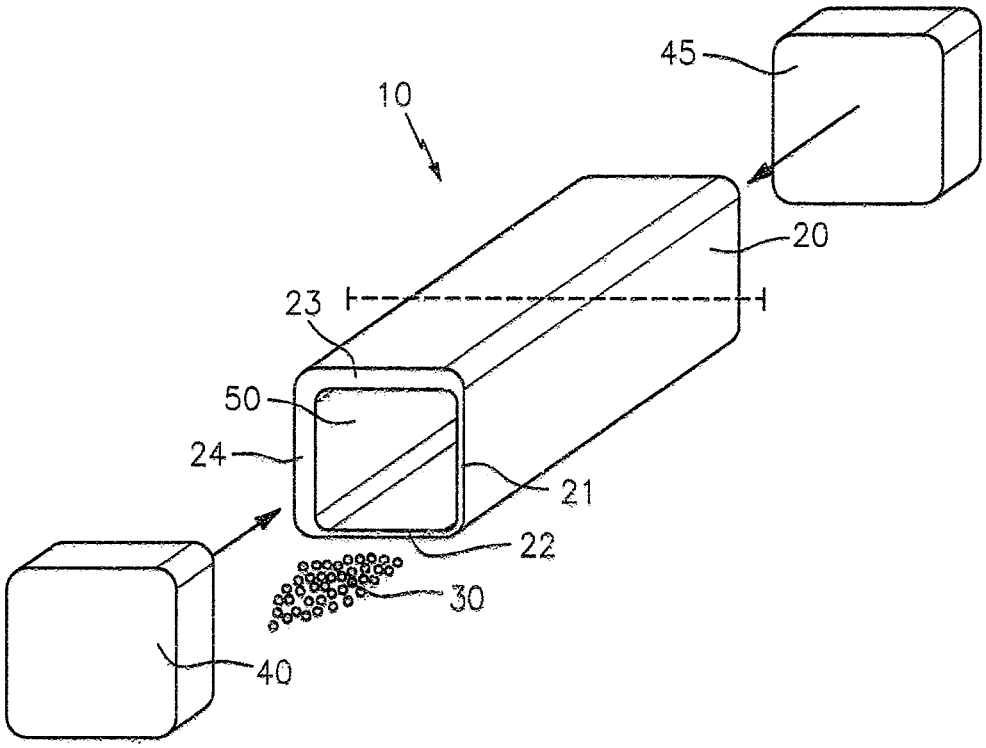
FIG. 1 is an exploded perspective view of a rhythm shaker according to one embodiment.

FIG. 1 shows a rhythm shaker 10 has a shell 20, percussive media 30, and a pair of end caps 40 and 45. Shell 20 and end caps 40 and 45 cooperate to define a closed interior cavity 50. Percussive media 30 is then confined within cavity 50 by shell 20 and end caps 40 and 45. In one embodiment, rhythm shaker 10 is rectangular cylinder in shape with a square cross-section across the longitudinal axis of rhythm shaker 10. However, rhythm shaker 10 can have virtually any configuration as shown in FIGS. 1 through 7.

As shown in FIG. 1, shell 20 preferably has a square or rectangular cross-sectional shape across one axis shown by dashed line I-I (the minor cross section) and preferably has a rectangular major cross-sectional shape. In a preferred embodiment shown in FIG. 1, shell 20 may be made from an extruded tube of metal forming a hollow body with four connected sidewalls 21, 22, 23 and 24.

The thicknesses of sidewalls 21, 22, 23 and 24 differ such that shaking the rhythm shaker 10 in one direction produces a sound that is different in tone or timber than the sound when rhythm shaker 10 is shaken in a different direction. In FIG. 1, sidewalls 21 and 22 are of a lesser thickness than sidewalls 23 and 24 such that when shaking rhythm shaker such that the percussive media 30 hits sidewalls 21 and 22, one particular sound will be generated whereas sidewalls 21 and 22 are of a lesser thickness than sidewalls 23 and 24 such that when shaking rhythm shaker such that the percussive media 30 hits sidewalls 23 and 24, a different particular sound will be generated.

Sidewalls 21, 22, 23, and 24 are made such that at least one sidewall has a thickness that is different from the other sidewalls. For example, in FIG. 1, sidewalls 21 and 22 are of the same thickness (within tolerances) and are thinner than sidewalls 23 and 24 which are themselves of the same thickness (within tolerances). The relative thicknesses of the sidewalls 21 and 22 as compared to sidewalls 23 and 24 can be selected by a person of ordinary skill in the art to achieve the desired sound effect.

Preferably, shell 20 may be made from a stock tube of metal with a hollow body with four connected sidewalls 21, 22, 23 and 24 of the same thickness (within tolerances) which is then milled on one or more sides to reduce the thickness of the milled sidewalls from the stock size. For example, to prepare the embodiment shown in FIG. 1, a stock square metal tube was cut to length and then milled on sidewalls 21 and 22 to reduce the thickness while leaving sidewalls 23 and 24 of stock thickness. Rhythm shaker 10 may also be cast rather than milled from standard stock. It has been found that when shell 20 is made of aluminum, with stainless steel ball bearings as percussive media, absolute thicknesses for the sidewall thicknesses for the thin sidewalls 21 and 22 ranges from up to about 1.5 mm whereas sidewall thicknesses for the thick sidewalls 23 and 24 ranges upwards from about 1.5 mm. Although other thicknesses can be selected by a person of ordinary skill in the art, depending on the material of manufacture of the shell and the material of the percussive media, to achieve the desired sound effect when rhythm shaker is operated.

In alternative embodiments, shell 20 can have only one open end and a closed end with one corresponding one end cap. For example, a square or rectangle cylinder of metal with an open top and closed bottom could be formed or milled as above such that shell and one end cap cooperate to define a closed interior cavity in which is housed the percussive media.

Figure 2:
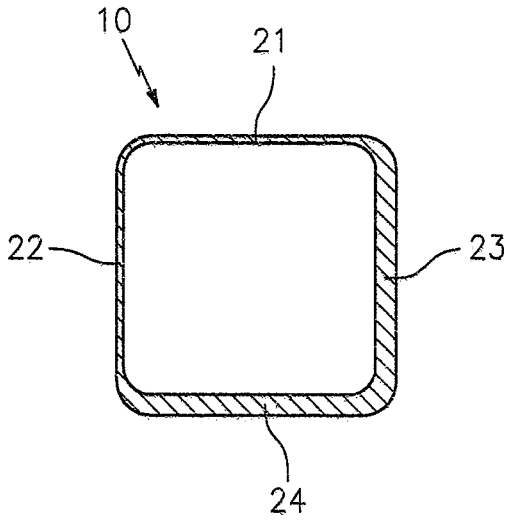
FIG. 2 is a cross sectional view of a rhythm shaker according to one embodiment.

FIG. 2 is a cross-sectional view of a rhythm shaker cut as shown in FIG. 1 across line I-I showing sidewalls. As can be seen in FIG. 2, the thicknesses of sidewalls 21, 22, 23 and 24 in this embodiment are such that sidewalls 21 and 22 are of a thinner thickness than sidewalls 23 and 24. In another embodiment, the thicker sidewalls may be on two parallel opposite sides. In another embodiment, three sidewalls may be of one thickness whereas the fourth sidewall may be of a different thickness. In this embodiment, shaking rhythm shaker 10 such that percussive media 30 (not shown in FIG. 2) produces one sound on the fore stroke with a different sound on the aft stroke.

Figure 3:
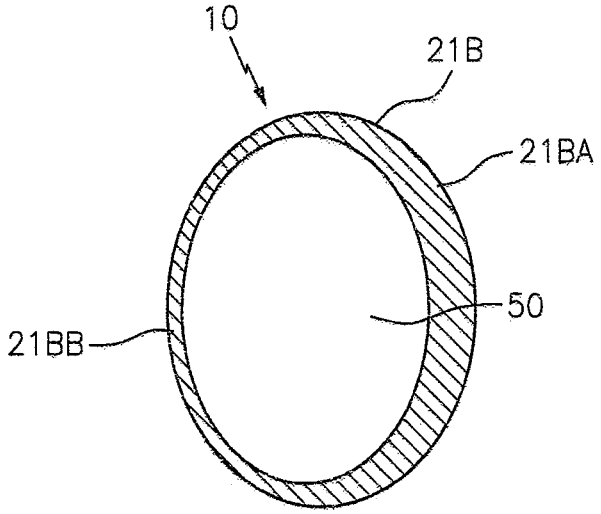
FIG. 3 is a cross sectional view of a rhythm shaker according to one embodiment.

FIG. 3 is a cross-sectional view of a rhythm shaker according to another embodiment of either an egg-shaped orb or an oval-cylinder. As shown in FIG. 3, shows sidewall 21B encloses and defines cavity 50. As can be seen in FIG. 3, the thickness of sidewall 21B varies around the cavity 50 such that it is thicker at location devoted by numeral 21BA in FIG. 3, and thinner at location denoted by numeral 21BB in FIG. 3. In this embodiment, shaking rhythm shaker 10 such that percussive media 30 (not shown in FIG. 3) produces one sound on the fore stroke with a different sound on the aft stroke.

Figure 4:
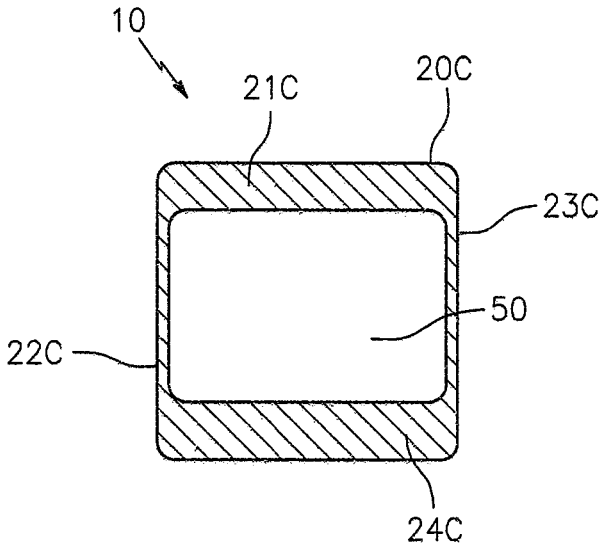
FIG. 4 is a cross sectional view of a rhythm shaker according to one embodiment.

FIG. 4 shows a cross-section of the rhythm shaker 10 according another embodiment. In FIG. 4, rhythm shaker 10 has a shell 20C, which defines a cavity 50 which houses percussive media 30 (not shown in FIG. 4). As is shown in FIG. 4, shell 20C is from an extruded tube of metal with a hollow body with four connected sidewalls 21C, 22C, 23C and 24C. The thicknesses of sidewalls 21C, 22C, 23C and 24C differ such that shaking the rhythm shaker 10 in one direction produces a sound that is different in tone or timber than the sound when rhythm shaker 10 is shaken in a different direction. In FIG. 4, sidewalls 21C and 24C are of a greater thickness than sidewalls 22C and 23C such that when shaking rhythm shaker such that the percussive media 30 hits sidewalls 21C and 24C, one particular sound will be generated whereas when shaking rhythm shaker such that the percussive media 30 hits sidewalls 22C and 23C, a different particular sound will be generated.

Figure 5:
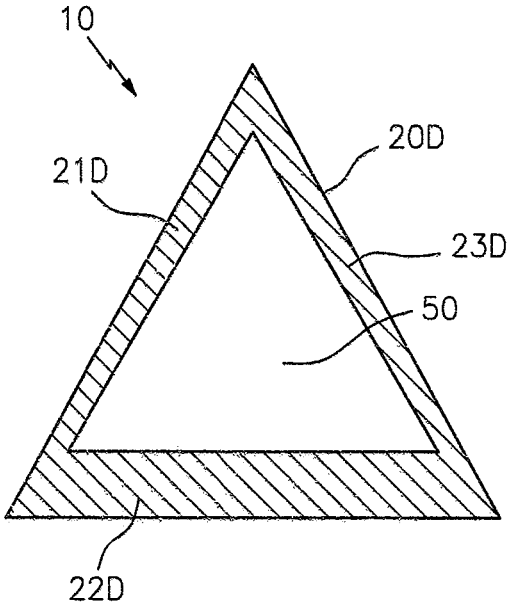
FIG. 5 is a cross sectional view of a rhythm shaker according to one embodiment.

FIG. 5 is a cross-sectional view showing the minor cross section of a rhythm shaker 10 showing sidewalls. FIG. 5 shows that the rhythm shaker 10 in this embodiment has a triangular cross-section. As can be seen in FIG. 5, the thicknesses of sidewalls 21D, 22D, and 23D are such that sidewalls 21D and 23D are of a thinner thickness than sidewall 22D to affect the sound when shaken.

Figure 6:
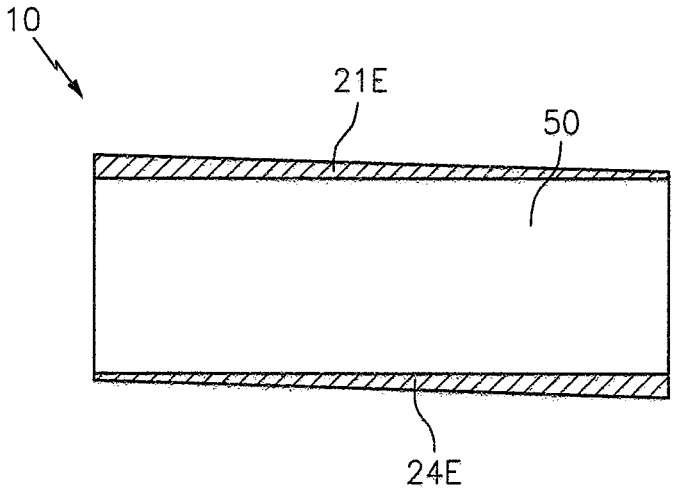
FIG. 6 is a cross sectional view of a rhythm shaker according to one embodiment.

FIG. 6 is a cross-sectional view showing the major cross section of a rhythm shaker 10 showing sidewalls according to another embodiment. FIG. 6 shows that the rhythm shaker 10 in this embodiment has sidewalls of varying thickness. The rhythm shaker 10 in this embodiment may be made from a stock tube of metal with a hollow body, with four connected sidewalls 21E, 22E, 23E and 24E of the same thickness (within tolerances) (side walls 22E and 23E not shown in this Figure) which is then milled to reduce the thickness of the milled sidewalls from the stock size in the manner as depicted in FIG. 6. For example, to prepare the embodiment shown in FIG. 6, a stock square metal tube was cut to length and then milled sidewall 21E and 24E at an angle to reduce the thickness of those sidewalls towards one end more than the other. For such an embodiment, thicknesses and angles can be selected by a person of ordinary skill in the art to achieve the desired sound effect when rhythm shaker is operated. Further, whether all or some sides are milled at an angle, at no angle or are not milled at all (or whether casting is used or other method of manufacture) can be selected by a person of ordinary skill in the art to achieve the desired effect.

Figure 7:
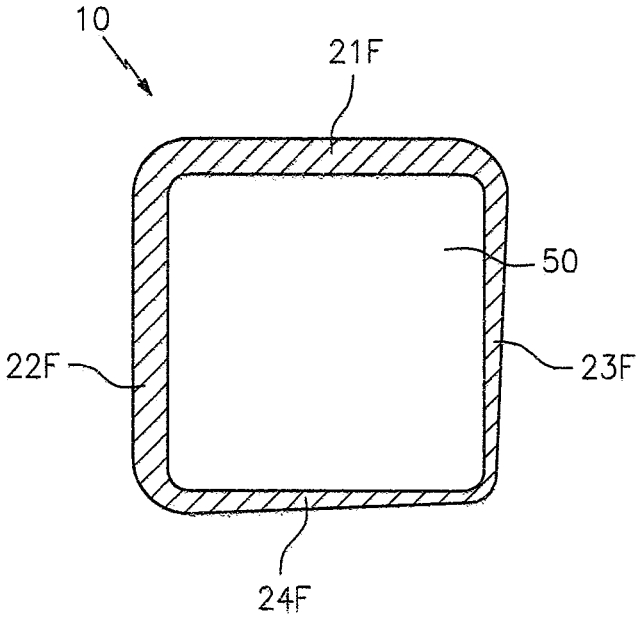
FIG. 7 is a cross sectional view of a rhythm shaker according to one embodiment.

FIG. 7 is a cross-sectional view showing the minor cross section of a rhythm shaker 10 showing sidewalls according to another embodiment. FIG. 7 shows that the rhythm shaker 10 in this embodiment has sidewalls of varying thickness. The rhythm shaker 10 in this embodiment may be made from a stock tube of metal with a hollow body with four connected sidewalls 21F, 22F, 23F, and 24F of the same thickness (within tolerances) which is then milled to reduce the thickness of the milled sidewalls from the stock size in the manner as depicted in FIG. 7. For example, to prepare the embodiment shown in FIG. 7, a stock square metal tube was cut to length and then two adjacent sidewalls 23F and 24F were milled at an angle to reduce the thickness of those sidewalls towards one end more than the other. For such an embodiment, thicknesses and angles can be selected by a person of ordinary skill in the art to achieve the desired sound effect when rhythm shaker is operated. Further, whether all or some sides are milled at an angle, at no angle or are not milled at all (or whether casting is used or other method of manufacture) can be selected by a person of ordinary skill in the art to achieve the desired effect.

Figure 8:
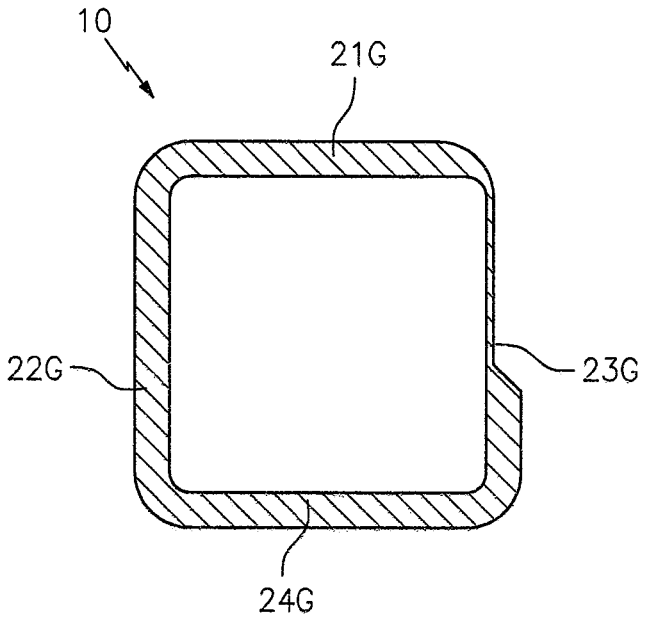
FIG. 8 is a cross sectional view of a rhythm shaker according to one embodiment.

FIG. 8 is a cross-sectional view showing the minor cross section of a rhythm shaker 10 showing sidewalls according to another embodiment. FIG. 8 shows that the rhythm shaker 10 in this embodiment has sidewalls of varying thickness but in a different manner of variation than the embodiment shown in FIG. 7 in which sidewalls vary in thickness constantly across the length of the sidewall. In this embodiment, sidewalls 21G and 22G and 24G are all of a uniform thickness whereas sidewall 23G has a thickness which varies but not in a constant manner across the length of the sidewall but rather in more of a stepwise fashion. One or more sidewalls may be milled in this fashion and the degree and position of the milling on any one milled side may be selected by a person or ordinary skill in the art to produce the desired effect. As above, thickness may be varied by milling a portion of a constant thickness shell down, or by forming the shell by casting or by other means known to a person of ordinary skill in the art, depending on the desired shape and tonal qualities and depending on the type of material for shell.

Figure 9:
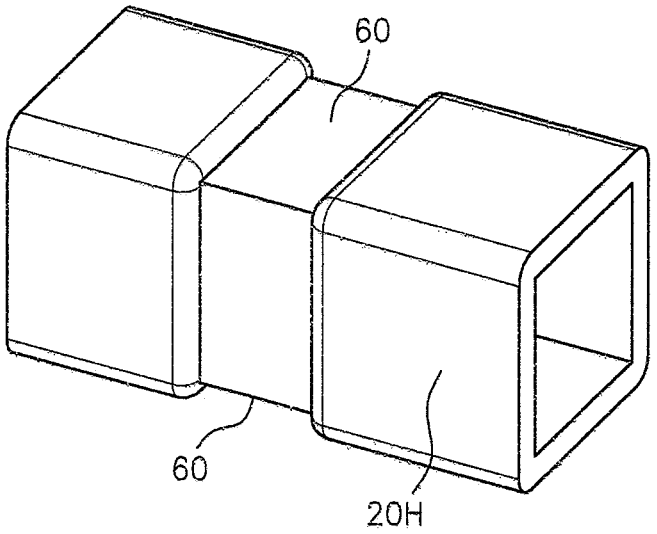
FIG. 9 is a perspective view of a rhythm shaker according to one embodiment.

FIG. 9 is a perspective view of shell 20H showing another manner in which the thickness of one or more sidewalls may vary. In this embodiment, shell 20H has sidewalls of varying thickness with an indentation 60 along the sidewall to produce another sound effect and to also allow for better grip of the rhythm shaker. As above, thickness may be varied to create indentations 60 by milling a portion of a constant thickness shell down or by forming the shell by casting or by other means known to a person of ordinary skill in the art depending on the desired shape and tonal qualities and depending on the type of material for shell.

Figure 10:
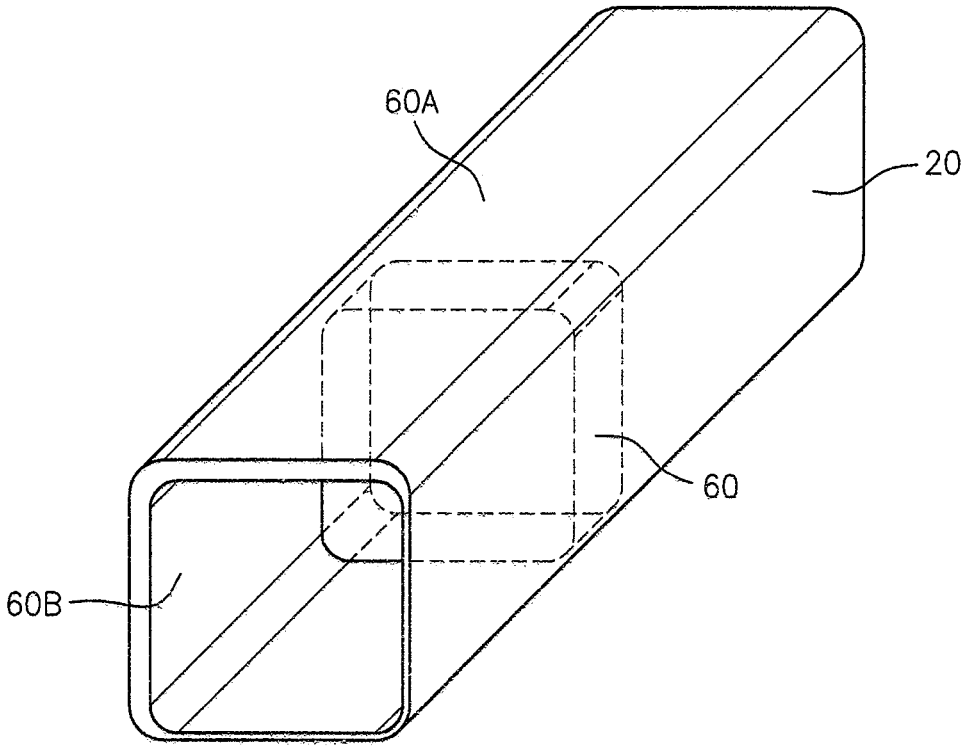
FIG. 10 is a perspective view of a rhythm shaker according to one embodiment.

FIG. 10 is a perspective view of a rhythm shaker according to one embodiment. In this embodiment, two cavities 60A and 60B are defined by shell 20 with an internal divider 60 and either endcap 40 or 45 depending on the side of divider 60. In this embodiment, one type of percussive media 30 may be located in cavity 60A and a different type, or amount, or size of percussive media 30 may be located in cavity 60B. The sidewalls may be varied in thickness corresponding to areas of sidewall defining both cavities, 60A and 60B, or only area of sidewall corresponding to one cavity, 60A or cavity 60B, in any manner as described above.

In an alternative embodiment shell may have a hexagonal cross-sectional shape or configuration. In another alternative embodiment shell 20 may have a circular cross-sectional shape. A person of ordinary skill in the art can select the shape of the rhythm shaker and the wall thicknesses to tune the rhythm shaker for particular sounds for a particular application such shapes include a regular polygon cross-section, an irregular polygon cross-section or a non-polygon. A person of ordinary skill in the art can select the material selected for sidewalls by a person of ordinary skill in the art to tune the rhythm shaker 10 to produce a particular sound or combination of sounds. For example shell may be made from any suitable material including, but not limited to, plastic, metal, glass, wood, bamboo, carbon fibre or combinations thereof. Coatings be selected for sidewalls by a person of ordinary skill in the art to tune the rhythm shaker 10 to produce a particular sound or combination of sounds. For example, a coating may be applied to two of four sidewalls in a rectangularly shaped rhythm shaker. Coatings may increase or decrease the hardness of the sidewall impacting the tone or timbre of the sound produced when struck by percussive media. A person of ordinary skill in the art can select percussive media from any sound producing material including, but not limited to, ball bearings, metal shot, buckshot, plastic bead, glass beads, pellets, seeds, rice small stones, or combinations thereof. Percussive media 30 can be selected a person of ordinary skill in the art to tune the rhythm shaker 10 to produce a particular sound or combination of sounds. Ball bearings, for example, can be made of stainless steel and can be selected to have a generally uniform diameters or can be selected to have various diameters.

In manufacture, may be made by extruding a tube of metal to form shell 20. Percussive media 30 may be placed inside the shell and sealed in with endcaps 40, 45. Endcaps may be made of rubber, metal, wood, plastic, carbon fibre, or other suitable material, and may be inserted into shell 20 and held in place by friction or adhesive or by mechanical or magnetic fastener or the like.

As described above, rhythm shaker 10 may be constructed from any traditional material. Furthermore, rhythm shaker 10 can be any size and shape.

The present invention having been thus been described with particular reference to the preferred forms thereof, it will be obvious that various changes and modifications may be made therein without departing from the spirit and scope of the present invention as defined in the appended claims.

The invention claimed is:

1. A rhythm shaker comprising: a shell having a plurality of sidewalls of a plurality of thicknesses, percussive media and at least one end cap, the plurality of sidewalls and the at least one end cap defining a closed interior cavity, the percussive media contained within the closed interior cavity such that upon moving the rhythm shaker in one direction the percussive media strikes at least one sidewall having one thickness to make a particular sound and, upon moving the rhythm shaker in a different direction, the percussive media strikes a different thickness of sidewalls to make a different particular sound.

2. The rhythm shaker of claim 1 including two end caps, the plurality of sidewalls and the two end caps defining the closed interior cavity, the percussive media contained within the closed interior cavity.

3. A rhythm shaker comprising: a shell having an enclosing sidewall of varying thickness, and percussive media, the sidewall of varying thickness defining an interior with the percussive media contained within the interior such that upon moving the rhythm shaker in one direction the percussive media strikes at least one sidewall thickness to make a particular sound and, upon moving the rhythm shaker in a different direction, the percussive media strikes a different sidewall thickness to make a different particular sound.

4. The rhythm shaker of claim 3 wherein the sidewall of varying thickness does not vary at a constant rate across the sidewall.

5. The rhythm shaker of claim 1 wherein the percussive media is selected from the group consisting of ball bearings, metal shot, buckshot, plastic bead, glass bead, pellet, seed, rice, stone, and any combinations thereof.

6. The rhythm shaker of claim 5 wherein the ball bearings are steel.

7. The rhythm shaker of claim 6 wherein the ball bearings are stainless steel.

8. The rhythm shaker of claim 7 wherein the ball bearings are stainless steel of a plurality of diameters.

9. The rhythm shaker of claim 1 wherein at least one of the plurality of sidewalls is made from a material selected from the group consisting of plastic, metal, wood, bamboo, carbon fibre, and any combinations thereof.

10. The rhythm shaker of claim 1 wherein the shell has a hexagonal cross-section.

11. The rhythm shaker of claim 1 wherein the shell has a square cross-section.

12. The rhythm shaker of claim 1 wherein the shell has a rectangular cross-section.

13. The rhythm shaker of claim 1 wherein the shell has four sidewalls and wherein two sidewalls are of a thinner thickness than the other two sidewalls.

14. The rhythm shaker of claim 13 wherein the two sidewalls of a thinner thickness are adjacent.

15. The rhythm shaker of claim 13 wherein the two sidewalls of a thinner thickness are not adjacent.

16. The rhythm shaker of claim 1 wherein the shell has a triangular cross-section.

17. The rhythm shaker of claim 3 wherein the shell has a tubular cross-section.

18. The rhythm shaker of claim 3 wherein the shell has an irregular cross-section.

19. The rhythm shaker of claim 3 wherein the shell has a circular cross-section.

20. The rhythm shaker of claim 3 wherein the shell has an oval cross-section.

21. The rhythm shaker of claim 1 wherein the shell is rigid.

22. The rhythm shaker of claim 1 wherein the percussive media is loosely disposed within the closed interior cavity for striking a portion of the closed interior cavity when the rhythm shaker is moved.

* * * * *